US009123452B2

(12) United States Patent
Sugiyama et al.

(10) Patent No.: US 9,123,452 B2
(45) Date of Patent: Sep. 1, 2015

(54) DIFFERENTIAL SIGNALING CABLE, TRANSMISSION CABLE ASSEMBLY USING SAME, AND PRODUCTION METHOD FOR DIFFERENTIAL SIGNALING CABLE

(75) Inventors: Takahiro Sugiyama, Hitachi (JP); Hideki Nounen, Hitachi (JP); Takashi Kumakura, Mito (JP); Yosuke Ishimatsu, Hitachi (JP)

(73) Assignee: HITACHI METALS, LTD., Tokyo (JP)

( * ) Notice: Subject to any disclaimer, the term of this patent is extended or adjusted under 35 U.S.C. 154(b) by 63 days.

(21) Appl. No.: 12/880,421

(22) Filed: Sep. 13, 2010

(65) Prior Publication Data

US 2011/0083877 A1 Apr. 14, 2011

(30) Foreign Application Priority Data

Oct. 14, 2009 (JP) ..... 2009-237430

(51) Int. Cl.

| | |
|---|---|
| ***H01B 11/04*** | (2006.01) |
| ***H01B 7/08*** | (2006.01) |
| *H01B 11/10* | (2006.01) |
| *H01B 11/20* | (2006.01) |

(52) U.S. Cl.

CPC ..... *H01B 7/0823* (2013.01); *H01B 11/1025* (2013.01); *H01B 11/1033* (2013.01); *H01B 11/1091* (2013.01); *H01B 11/20* (2013.01)

(58) Field of Classification Search

USPC ..... 174/113 R, 115, 117 F

See application file for complete search history.

(56) References Cited

U.S. PATENT DOCUMENTS

| | | | | |
|---|---|---|---|---|
| 5,037,999 | A * | 8/1991 | VanDeusen | 174/36 |
| 5,091,610 | A * | 2/1992 | Strauss | 174/117 F |
| 5,138,284 | A * | 8/1992 | Yabuki et al. | 331/56 |
| 5,142,100 | A * | 8/1992 | Vaupotic | 174/24 |
| 5,235,296 | A * | 8/1993 | Saka | 333/109 |
| 5,283,390 | A | 2/1994 | Hubis et al. | |
| 6,403,887 | B1 * | 6/2002 | Kebabjian et al. | 174/110 R |
| 6,504,379 | B1 * | 1/2003 | Jackson | 324/539 |
| 2002/0017393 | A1 | 2/2002 | Hanna-Myrick | |
| 2008/0073105 | A1 * | 3/2008 | Clark et al. | 174/112 |
| 2008/0304578 | A1 | 12/2008 | Matsubara et al. | |

FOREIGN PATENT DOCUMENTS

| | | |
|---|---|---|
| CN | 101335106 | 12/2008 |
| JP | 63-29413 | 2/1988 |
| JP | 2001-035270 | 2/2001 |

(Continued)

OTHER PUBLICATIONS

JP Office Action of Appln. No. 2009-237430 dated Jul. 31, 2012 with partial English translation.

(Continued)

*Primary Examiner* — Chau N Nguyen

(74) *Attorney, Agent, or Firm* — McGinn IP Law Group, PLLC

(57) ABSTRACT

A differential signaling cable according to the present invention comprises: a pair of signal conductors provided in parallel; an insulator which covers the periphery of the pair of signal conductors in a batch; and a shield conductor provided on the outer periphery of the insulator, in which an interval between the pair of signal conductors is specified so that even-mode impedance becomes 1.5 to 1.9 times odd-mode impedance.

20 Claims, 6 Drawing Sheets

(56) References Cited

FOREIGN PATENT DOCUMENTS

| | | |
|---|---|---|
| JP | 2002-056727 | 2/2002 |
| JP | 2002-289047 | 10/2002 |
| JP | 2003-297154 | 10/2003 |
| JP | 2007-026909 | 2/2007 |
| JP | 2007-059323 | 3/2007 |
| JP | 2008-226564 | 9/2008 |
| JP | 2009-021978 | 1/2009 |

OTHER PUBLICATIONS

Office Action issued in Chinese Patent Application No. 201010506544.7 on Feb. 12, 2014.

* cited by examiner

DIFFERENTIAL SIGNALING CABLE, TRANSMISSION CABLE ASSEMBLY USING SAME, AND PRODUCTION METHOD FOR DIFFERENTIAL SIGNALING CABLE

CLAIM OF PRIORITY

The present application claims priority from Japanese patent application serial no. 2009-237430 filed on Oct. 14, 2009, the content of which is hereby incorporated by reference into this application.

BACKGROUND OF THE INVENTION

1. Field of the Invention

The present invention relates to a differential signaling cable used for transmitting high-speed digital signals of several Gbps or more, a transmission cable assembly using the differential signaling cable, and a production method for the differential signaling cable. And specifically, the invention relates to a differential signaling cable in which signal integrity does not deteriorate much, a transmission cable assembly using the differential signaling cable, and a production method for the differential signaling cable.

2. Description of Related Art

In servers, routers, and storage products which handle high-speed digital signals of several Gbps or more, differential signaling is often used for transmission between electronic devices or between boards located in an electronic device. Such electronic devices or boards located in an electronic device are electrically connected by a differential signaling cable.

Transmission of differential signaling uses two signals which have had their phases inverted, and a difference between the two signals is synthesized and outputted on the receiving side. The differential signaling cable is equipped with two signal conductors (also referred to as conducting wire or cable core) to transmit two signals that have had their phases inverted.

Because in a differential signaling cable, currents passing through two signal conductors flow in opposite directions to each other, an advantage is that there is a decreased amount of electromagnetic waves externally emitted. Furthermore, in a differential signaling cable, because noise coming from outside is superimposed equally by two signal conductors, another advantage is that an effect of noise can be eliminated by synthesizing and outputting the difference between two signals on the receiving side. For these reasons, transmission using differential signals is suitable for transmitting high-speed digital signals.

Conventional differential signaling cables include a twisted pair cable in which a signal conductor is covered by an insulator and two of those insulated wires are twisted to form a pair. Since the twisted pair cable is inexpensive, balanced, and easily bent, it is widely used for intermediate-distance signal transmission.

However, because the twisted pair cable does not have a conductor equivalent to a ground, it is easily affected by metals located near the cable and the characteristic impedance is not stable. For these reasons, in the twisted pair cable, there is a problem such that signal waveform is prone to collapse in the high-frequency area of several GHz. Therefore, the twisted pair cable is not often used as the transmission cable when several Gbps or more are to be transmitted.

On the other hand, another type of differential signaling cable is a twin-axial (twinax) cable in which two insulated wires are disposed in parallel without being twisted, and those wires are covered by a shield conductor. In comparison with a twisted pair cable, because in the twin-axial (twinax) cable, a difference in the physical length between two conductors is small and the shield conductor covers the two insulated wires as a whole, the characteristic impedance does not become unstable even when metals are located near the cable, and noise resistance is high. Therefore, the twin-axial cable is used for short-distance (from several meters to several tens of meters) signal transmission at comparatively high-speed (high-rate). Shield conductors for twin-axial cable include conductors using a tape with a conductor (metal foil tape), using a braided wire, attaching a grounding drain wire, and the like.

As an example, JP-A 2002-289047 discloses a twin-axial cable. FIG. 8 is a schematic illustration showing a cross-sectional view of a twin-axial cable as a conventional differential signaling cable.

As shown in FIG. 8, a twin-axial cable 81 is structured such that two insulated wires 84, each made by insulating signal conductors 82 with an insulator 83, are wrapped around or longitudinally supported by a shield conductor 85 which is a metal foil tape made by laminating a polyethylene tape with metal foil such as aluminum or the like, and then the shield conductor 85 is covered by a jacket 86 to protect the inside of the cable. Between the shield conductor 85 and the insulated wires 84, a drain wire 87 is longitudinally disposed so that it comes in contact with the conductive surface (metal foil) of the shield conductor 85, thereby grounding the drain wire 87.

However, in order to transmit high-speed signals of several Gbps or more, it is necessary to reduce skew which is a difference in propagation time of two signals between the two signal conductors. This is because the waveform of digital signals outputted by synthesizing the difference between two signals on the receiving side collapses with increasing the skew. For example, in the transmission of high-speed signals equivalent to 10 Gbps, a skew of only several ps (picoseconds) can deteriorate signal quality. Furthermore, recently, in terms of the necessity for reducing EMI (electromagnetic interference; electromagnetic wave interruption), it is also required to make the differential-to-common-mode conversion quantity low.

Another twin-axial cable is disclosed in JP-A 2001-35270. FIG. 9 is a schematic illustration showing a cross-sectional view of another twin-axial cable as a conventional differential signaling cable. As shown in FIG. 9, a twin-axial cable 91 is structured such that two signal conductors 92 are together covered with an insulator 93, and the insulator 93 is wrapped around or longitudinally supported by a shield conductor 94 which is a metal foil tape, and then the shield conductor 94 is covered by a jacket 95 to protect the inside of the cable. The twin-axial cable 91 makes it possible to suppress a permittivity difference of the insulator 93 and reduce the skew by covering both of the two signal conductors 92 together by an insulator 93.

Still another twin-axial cable is disclosed in JP-A 2007-26909. FIG. 10 is a schematic illustration showing a cross-sectional view of still another twin-axial cable as a conventional differential signaling cable. As shown in FIG. 10, a twin-axial cable 101 is structured such that two insulated wires 104, each made by covering a signal conductor 102 with an insulator 103, are covered by a foaming agent tape 105, and the foaming agent tape 105 is then covered by a shield conductor 106 which is a metal foil tape, then the shield conductor 106 is finally covered by a jacket 107. Between the foaming agent tape 105 and the shield conductor 106, a drain wire 108 is longitudinally disposed so that it comes in contact with the conductive surface (metal foil) of the shield conductor 106. In the twin-axial cable 101, before two insulated wires 104 are covered by a shield conductor 106, they are wrapped with a foaming agent tape 105 functioning as an insulator to keep a relative distance between the signal conductor 102 and the shield conductor 106, thereby enhancing an electromagnetic coupling of both signal conductors 102 and reducing the skew.

Still another twin-axial cable is disclosed in U.S. Pat. No. 5,283,390. FIG. 11 is a schematic illustration showing a cross-sectional view of still another twin-axial cable as a conventional differential signaling cable. As shown in FIG. 11, a twin-axial cable 111 is structured such that two insulated wires 114, each made by covering a signal conductor 112 with an insulator 113 made of a foamed body, are wrapped around or longitudinally supported by a shield conductor 115 which is a metal foil tape, and the shield conductor 115 is then covered by a jacket 116. In the twin-axial cable 111, the insulator 113 is made of a foamed body, and when the two insulated wires 114 are covered by a tape-like shield conductor 115, they are wrapped so tightly that the insulators 113 are slightly deformed in order to make the distance between the two signal conductors 112 small. By doing so, electromagnetic coupling of the two signal conductors 112 is enhanced and the skew is reduced.

As mentioned above, in the twin-axial cable 91 shown in FIG. 9, the skew is reduced by covering the two signal conductors 92 together with the insulator 93. However, by simply covering both of the signal conductors 92 with the insulator 93 as a whole, deviation of the permittivity distribution in the insulator 93 and deviation of the bilaterally symmetric property of the shape of the shield slightly remain. Therefore, effects of sufficient reduction of both the skew and the differential-to-common-mode conversion quantity may not be obtained in some cases when high-speed signals equivalent to 10 Gbps are transmitted.

Furthermore, in the twin-axial cable 101 shown in FIG. 10, since the process of wrapping the foaming agent tape 105 is added, an increase in production costs is inevitable. Moreover, the effects of the skew reduction cannot be obtained unless a relatively thick foaming agent tape 105, such as 0.2 mm thick foaming agent tape 105 is used. Therefore, the bilaterally symmetric property is destroyed depending on the overwrapping condition of the foaming agent tape 105, creating problems in that the skew and the differential-to-common-mode conversion quantity may increase and characteristic impedance may fluctuate. Consequently, it is necessary to precisely control the overwrapping condition of the foaming agent tape 105, however, it is very difficult during the actual process.

In the case of the twin-axial cable 111 shown in FIG. 11, the insulator 113 is deformed by wrapping the two insulated wires 114 with the tape-like shield conductor 115, however, it is difficult to control the distance between the two signal conductors 112, and when the bilaterally symmetric property is destroyed, problems may be created in that the skew and the differential-to-common-mode conversion quantity increase and characteristic impedance fluctuates.

Furthermore, in terms of electrical characteristics, in order to enhance electromagnetic coupling of the two signal conductors, there is a problem such that the desired characteristic impedance (differential impedance) cannot be obtained unless an outer diameter of the cable is made large or the signal conductor is made thin. That is, when the outer diameter of the cable is not changed, the signal conductor has to be made small. Consequently, transmission loss of the cable inevitably increases. On the contrary, when electromagnetic coupling is too strong, in-phase characteristic impedance becomes large. Consequently, characteristic impedance becomes inconsistent with the in-phase input component. As a result, reflection of the in-phase component occurs, which is prone to cause problems such as EMI or the like.

Furthermore, on the mounting surface, in order to enhance electromagnetic coupling of the two signal conductors, it is necessary to make the interval between the two signal conductors relatively small with regard to the outer diameter of the cable. However, when soldering the twin-axial cable onto a board or a connector, the connection pitch becomes small, which tends to make connecting work difficult.

Normally, a drain wire is disposed between the two insulated wires by considering the stability of the bilaterally symmetric property and the position (see, e.g., FIGS. 8 and 10). However, when the connection pitch is small (i.e., the interval between the two signal conductors is small), it is difficult to make connections in their mounting condition, and it is necessary to use a method which peels away a shield conductor to a certain degree and pulls out the drain wire to the edge of the signal conductor and then solders the two signal conductors and the drain wire. Pulling out the drain wire too far makes the grounding unstable, causing electrical characteristics to deteriorate.

SUMMARY OF THE INVENTION

In view of the foregoing, it is an objective of the present invention to address the above problems and to provide a differential signaling cable used for the transmission of high-speed signals of several Gbps or more, a transmission cable assembly using the differential signaling cable, and a production method for the differential signaling cable. In the above differential signaling cable, the skew, differential-to-common-mode conversion quantity, and transmission loss are all reduced; the EMI performance is good; characteristic impedance that determines transmission characteristics does not successively fluctuate; and stable production is possible. In addition, mounting to a board, connector, or the like is easy; electrical characteristics in the mounting portion do not deteriorate much; and signal waveform does not deteriorate much.

(1) According to an aspect of the present invention, there is provided a differential signaling cable comprising: a pair of signal conductors provided in parallel; an insulator covering a periphery of the pair of signal conductors as a whole; and a shield conductor provided on an outer periphery of the insulator, in which an interval between the pair of signal conductors is specified so that even-mode impedance becomes 1.5 to 1.9 times odd-mode impedance.

In the above aspect (1) of the present invention, the following modifications and changes can be made.

(i) A length of the insulator in its width direction in which the pair of signal conductors is arranged is made longer than a length in its thickness direction perpendicular to the width direction, and the pair of signal conductors is disposed at a center of the thickness direction of the insulator.

(ii) A ratio of the length of the insulator in its width direction to the length in its thickness direction is 2:1.

(iii) A drain wire is longitudinally disposed on an end on one side or ends on both sides of the insulator in its width direction, the drain wire being provided between the insulator and the shield conductor, the drain wire being electrically connected to the shield conductor.

(iv) The drain wire and the signal conductor are linearly disposed along the width direction of the insulator.

(v) Each drain wire is disposed on the ends on both sides of the insulator in its width direction; both drain wires are linearly disposed along the width direction of the insulator; and both drain wires are disposed in locations deviating from the center of the thickness direction of the insulator.

(vi) The drain wire is engaged with an engagement groove formed on the end on one side or the ends on both sides of the insulator in its width direction.

(vii) A transmission cable assembly is structured such that: at least two or more of the above-mentioned differential signaling cables are bundled; a batch-covering shield conductor is provided on a periphery of the bundled cables as a whole; and an outer periphery of the batch-covering shield conductor is covered with a jacket made of an insulator.

(2) According to another aspect of the present invention, there is provided a production method for a differential signaling cable comprising a pair of signal conductors provided in parallel, an insulator covering a periphery of the pair of signal conductors as a whole, and a shield conductor provided on an outer periphery of the insulator is provided, in which each conductor of the pair of signal conductors is disposed such that an interval therebetween is specified as even-mode impedance becomes 1.5 to 1.9 times odd-mode impedance, and the insulator is formed in a batch on the periphery of the pair of signal conductors by means of extrusion molding.

Advantages of the Invention

According to the present invention, it is possible to provide a differential signaling cable, a transmission cable assembly using the differential signaling cable, and a production method for the differential signaling cable. In the above differential signaling cable, the skew, differential-to-common-mode conversion quantity, and transmission loss are all reduced; the EMI performance is good; characteristic impedance that determines transmission characteristics does not successively fluctuate; and stable production is possible. In addition, mounting to a board, connector, or the like is easy; electrical characteristics in the mounting portion do not deteriorate much; and signal waveform does not deteriorate much.

DETAILED DESCRIPTION OF THE PREFERRED EMBODIMENTS

Hereafter, a preferred embodiment of the present invention will be described with reference to the attached drawings. However, the present invention is not intended to be limited to the following embodiments, and it is obvious that various changes may be made without departing from the scope of the invention.

First Embodiment of Present Invention

Figure 1:
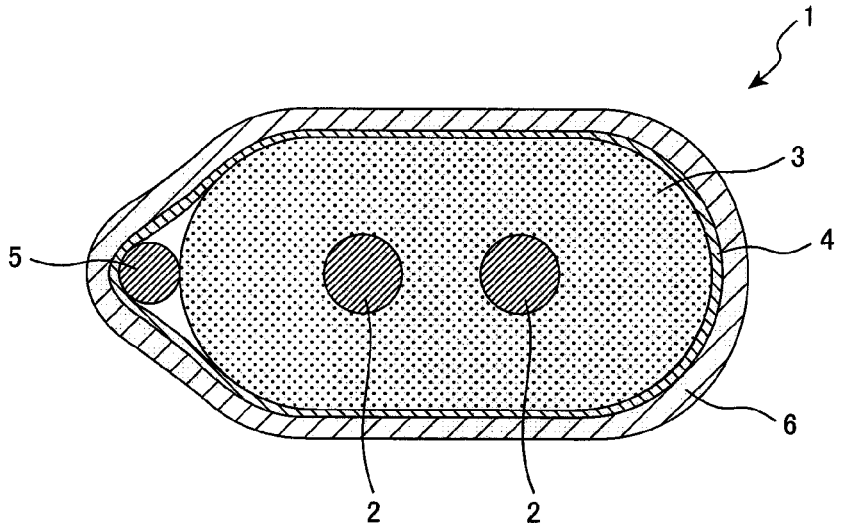
FIG. 1 is a schematic illustration showing a cross-sectional view of an exemplary differential signaling cable according to a first embodiment of the present invention.

FIG. 1 is a schematic illustration showing a cross-sectional view of an exemplary differential signaling cable according to a first embodiment of the present invention. As shown in FIG. 1, a differential signaling cable 1 comprises: a pair of signal conductors 2 provided in parallel; an insulator 3 having a predetermined permittivity which covers in a batch the periphery of both signal conductors 2; a shield conductor 4 provided on the outer periphery of the insulator 3; a drain wire 5 for grounding longitudinally disposed between the insulator 3 and the shield conductor 4; and a jacket 6 for cable protection provided on the outer periphery of the shield conductor 4.

The signal conductor 2 is a good electrical conductor made of copper or the like. Furthermore, the signal conductor 2 is a single wire or a twisted wire made by plating a metal on the good electrical conductor. In a differential signaling cable 1 according to this embodiment, an interval between two signal conductors 2 is specified so that even-mode impedance $Z_{even}$ becomes 1.5 to 1.9 times that of odd-mode impedance $Z_{odd}$. The reason for this will be described later.

The insulator 3 is formed in a flattened shape when its cross-section is viewed. Assuming that the direction along which the pair of signal conductors 2 are arranged (horizontal direction in FIG. 1) is a width direction and the direction perpendicular to the width direction (vertical direction in FIG. 1) is a thickness direction, the insulator 3 is formed such that a length in the width direction (hereafter, simply referred to as width) is larger than a length in the thickness direction (hereafter, simply referred to as thickness).

In this embodiment, the shape of the insulator 3 when its cross-section is viewed appears as two approximately straight sides and two curved sides connecting to the two approximately straight sides (e.g., racetrack geometry). Also, the insulator 3 may be in the shape of an ellipse when its cross-section is viewed. Both signal conductors 2 are disposed at a center (on a centerline) of the thickness direction of the insulator 3. In most cases, two differential signaling cables 1 are used as a pair to transmit and receive signals, therefore, to make the cross-section shape of the united two cables as close to a circle as possible, it is preferable that the ratio of the width to the thickness of the insulator 3 be 2:1.

The insulator 3 is created such that both signal conductors 2 are covered in a batch with an insulating resin provided by, e.g., an extruding machine. It is preferable that the insulating resin used for the insulator 3 has a small permittivity, small dielectric tangent, and be made of, e.g., polytetrafluoroethylene (PTFE), perfluoroalkoxy (PFA), polyethylene, and the like.

Furthermore, in order to make the permittivity and the dielectric tangent small, expanded insulating resin may be used as an insulator 3. When using expanded insulating resin as an insulator 3, it is recommended that the insulator 3 be formed by using a method which kneads a foaming agent before molding and controls the degree of foaming according to the temperature used during the molding process or a method that injects nitrogen gas or the like by the pressure used during the molding process and executes foaming at the time when pressure is being released.

On an end on one side of the insulator 3 in its width direction (the left end in FIG. 1), a drain wire 5 is longitudinally disposed in parallel with both of the two signal conductors 2. That is, the drain wire 5 and the two signal conductors 2 are linearly disposed along the width direction of the insulator 3. In the same manner as a signal conductor 2, a drain wire 5 is made of an electrical good conductor such as copper or the like. Also, the drain wire 5 is a single wire or a twisted wire made by plating a metal on the good electrical conductor.

As a shield conductor 4, a metal foil tape made by laminating a polyethylene tape with a metal foil such as aluminum or the like is used. The shield conductor 4 is not limited to the above, and a braided wire may also be used. The shield conductor 4 is wrapped around the periphery of the insulator 3 and the drain wire 5, thereby the drain wire 5 is securely fixed onto the insulator 3. In this process, the shield conductor 4 is wrapped so that the conductive surface (metal foil) of the shield conductor 4 comes in contact with the drain wire 5. Furthermore, the outer periphery of the shield conductor 4 is covered by a jacket 6 made of an insulator to protect the cable.

Figure 2:
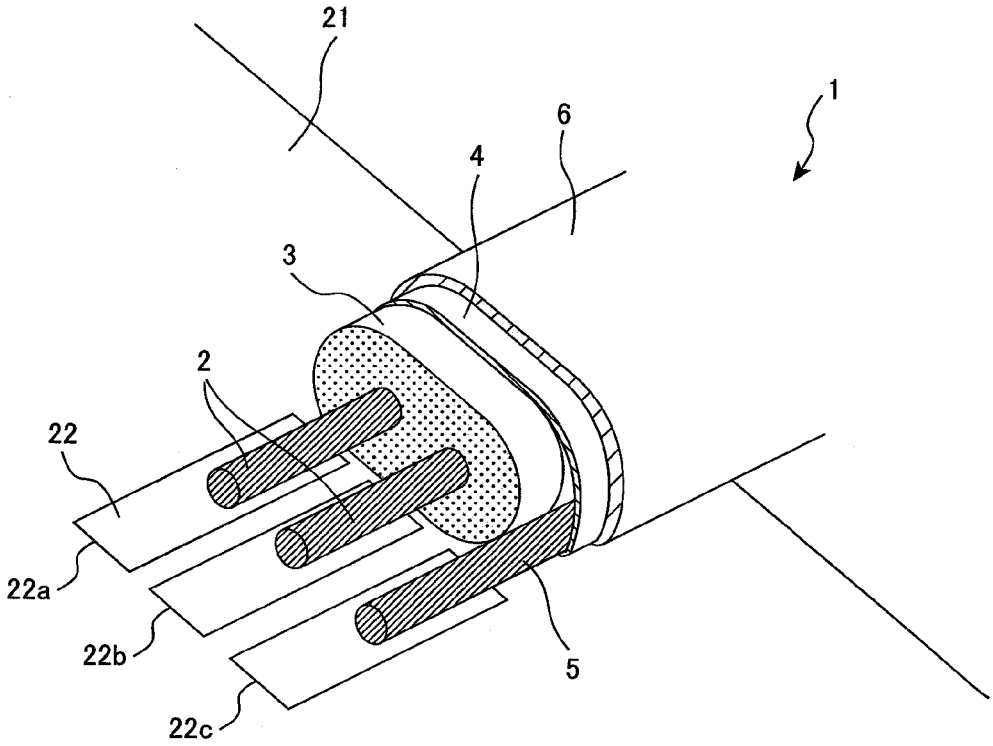
FIG. 2 is a schematic illustration showing a perspective view in which the differential signaling cable in FIG. 1 is mounted onto a printed-circuit board.

FIG. 2 is a schematic illustration showing a perspective view in which the differential signaling cable in FIG. 1 is mounted onto a printed-circuit board. As shown in FIG. 2, when mounting the differential signaling cable 1 onto, e.g., a printed-circuit board 21, the jacket 6, the shield conductor 4, and the insulator 3 are sequentially peeled away in a cascading manner to expose the signal conductors 2 and the drain wire 5. Then in this position, the signal conductors 2 are soldered onto signal electrodes 22 (P-electrode 22*a*, N-electrode 22*b*) on the printed-circuit board 21, and the drain wire 5 is soldered onto a ground electrode 23.

Thus, in the differential signaling cable 1 according to the present invention, it is possible to solder the signal conductors 2 and the drain wire 5 while they are exposed, and even if the interval between the two signal conductors 2 is small, it is possible to mount the signal conductors 2 without interfering with the drain wire 5. Furthermore, because the exposed portion of the shield conductor 4 is small, electrical characteristics do not deteriorate.

Herein, an explanation will be made about why the interval between the two signal conductors 2 is specified so that even-mode impedance $Z_{even}$ becomes 1.5 to 1.9 times that of odd-mode impedance $Z_{odd}$.

In a differential signaling cable 1, since the periphery of both signal conductors 2 is covered in a batch by an insulator 3 by extrusion molding, it is possible to flexibly specify the interval between the two signal conductors 2 and to achieve a desired degree of the electromagnetic coupling of the two signal conductors 2. However, it is necessary to determine the interval between the two signal conductors 2 by considering the reduction of skew and differential-to-common-mode conversion quantity and the reduction of transmission loss.

For example, in a differential signaling cable with no electromagnetic coupling, electromagnetic waves passing through the inside of the cable separately propagate between one signal conductor and the shield conductor and between the other signal conductor and the shield conductor. Therefore, a slight difference in the propagation constant in each route affects the increase in the skew and the differential-to-common-mode conversion quantity. That is, the skew and the differential-to-common-mode conversion quantity of the differential signaling cable increase with decreasing the electromagnetic coupling of both signal conductors.

On the other hand, when the electromagnetic coupling of both signal conductors is strong, among electromagnetic waves propagating inside the cable, components propagating between the two signal conductors increase, thereby reducing the skew and the differential-to-common-mode conversion quantity. However, an electromagnetic field concentrates between the two signal conductors, which increases the cable's transmission loss. Furthermore, when electromagnetic coupling of the two signal conductors is strong, in-phase impedance of the cable becomes large, and the characteristic impedance is prone to become inconsistent with the in-phase input component. As a result, reflection of the in-phase component occurs, resulting in the occurrence of EMI. That is, as the electromagnetic coupling of the two signal conductors becomes strong, the transmission loss increases and the EMI performance deteriorates.

A degree of electromagnetic coupling of two signal conductors can be prescribed according to the ratio of even-mode impedance $Z_{even}$ to odd-mode impedance $Z_{odd}$ of the signal conductors ($Z_{even}/Z_{odd}$). The even-mode impedance $Z_{even}$ is the impedance to the ground when both signal conductors are excited without providing a phase difference; and the odd-mode impedance $Z_{odd}$ is the impedance to the ground when both signal conductors are excited with opposite phases.

The $Z_{even}/Z_{odd}$ can be adjusted according to an interval between the two signal conductors. When the interval between the two signal conductors is made small, the value of $Z_{even}/Z_{odd}$ becomes high, increasing the degree of the electromagnetic coupling of the two signal conductors. Furthermore, the $Z_{even}/Z_{odd}$ can also be adjusted according to an outer diameter of the signal conductors. In that case, adjustment of $Z_{even}/Z_{odd}$ according to the outer diameter of the signal conductors is necessary to make the differential impedance be 100 Ω.

Figure 3:
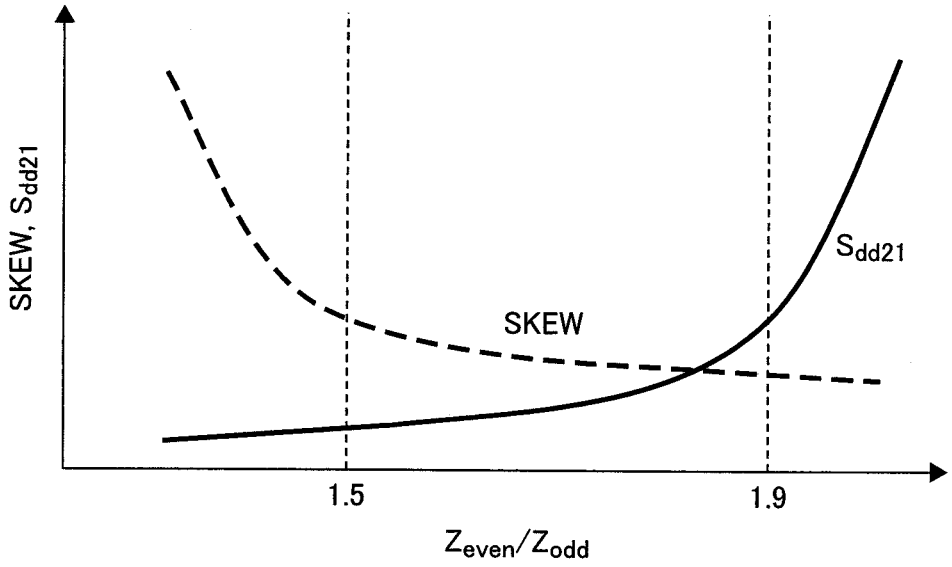
FIG. 3 shows an analytical result of a relationship between skew and transmission characteristics (differential mode insertion loss $S_{dd21}$) with regard to a degree ($Z_{even}/Z_{odd}$) of electromagnetic coupling of two signal conductors in a differential signaling cable.

FIG. 3 shows an analytical result of a relationship between skew and transmission characteristics (differential mode insertion loss $S_{dd21}$) with regard to a degree ($Z_{even}/Z_{odd}$) of the electromagnetic coupling of two signal conductors in a differential signaling cable. As shown in FIG. 3, when $Z_{even}/Z_{odd}$ is less than 1.5, the effect of reduction of skew is small (the skew significantly increases), and when $Z_{even}/Z_{odd}$ exceeds 1.9, the transmission characteristics significantly deteriorate (the differential mode insertion loss $S_{dd21}$ significantly increases). Therefore, in order to reduce the skew and to inhibit the deterioration of transmission characteristics, the interval between the two signal conductors 2 can be specified so that $Z_{even}/Z_{odd}$ becomes 1.5 to 1.9, that is, even-mode impedance $Z_{even}$ becomes 1.5 to 1.9 times that of odd-mode impedance $Z_{odd}$.

Generally, differential impedance is set at 100 Ω, therefore, $Z_{odd}$=50Ω and $Z_{even}$=75 to 95Ω are established. For example, assuming that: an effective outer diameter of the signal conductor 2 is 0.18 mm; PFA (specific permittivity $\in_r$=2.1) is used as an insulator 3; the insulator 3 is 1.48 mm wide and 0.74 mm thick; and the interval between the two signal conductors 2 is 0.375 mm, the differential impedance of the signal conductors 2 is 100Ω; the in-phase impedance is approximately 42Ω; and the $Z_{even}/Z_{odd}$ is 1.67.

In the same manner, with regard to a plurality of differential signaling cables that are different in size, the $Z_{even}/Z_{odd}$, skew, differential mode insertion loss $S_{dd21}$, and in-phase mode reflection loss (return loss) $S_{cc11}$ were investigated and analysis results are shown in Table 1. In Table 1, conductor configuration, e.g., "7/0.08" indicates that a signal conductor is configured by twisting seven wires each having an outer diameter of 0.08 mm. Furthermore, the attenuation quantity is equal to an absolute value of differential mode insertion loss $S_{dd21}$, indicating the signal attenuation quantity per meter.

TABLE 1

| Size | Conductor configuretion | Outer diameter (mm) | Effective outer diameter (mm) | Distance d between signal conductors (mm) | $Z_{even}/Z_{odd}$ | Skew (ps/m) | Differential mode insertion loss $S_{dd21}$ (dB/m at 2.5 GHz) | Attenuation quantity (dB/m at 2.5 GHz) | In-phase mode reflection loss $S_{cc11}$ (dB/m at 2.5 GHz) |
|---|---|---|---|---|---|---|---|---|---|
| 32AWG | 7/0.08 | 0.240 | 0.226 | 0.580 | 1.15 | 18 | −3.4 | 3.4 | −46.1 |
| 33AWG | 7/0.071 | 0.213 | 0.200 | 0.440 | 1.50 | 14 | −3.5 | 3.5 | −23.1 |
| 34AWG | 7/0.064 | 0.192 | 0.180 | 0.375 | 1.67 | 13 | −3.9 | 3.9 | −12.0 |
| 35AWG | 7/0.056 | 0.168 | 0.158 | 0.327 | 1.88 | 12.5 | −4.3 | 4.3 | −10.3 |
| 36AWG | 7/0.05 | 0.150 | 0.141 | 0.275 | 2.08 | 12 | −4.8 | 4.8 | −9.1 |
| 37AWG | 7/0.045 | 0.134 | 0.126 | 0.240 | 2.25 | 11.8 | −5.4 | 5.4 | −7.2 |

As shown in Table 1, in a 32 AWG differential signaling cable having the $Z_{even}/Z_{odd}$ of less than 1.5, the skew was large, 18 ps/m. On the contrary, in 36 AWG and 37 AWG differential signaling cables having the $Z_{even}/Z_{odd}$ of more than 1.9, the attenuation quantity that is an absolute value of differential mode insertion loss $S_{dd21}$ was large, 4.8 dB/m and 5.4 dB/m, respectively, which indicated that the transmission characteristics deteriorated. Furthermore, in the 36 AWG and 37 AWG differential signaling cables having the $Z_{even}/Z_{odd}$ of more than 1.9, the in-phase mode reflection loss $S_{cc11}$ was more than −10 dB/m (i.e., an absolute value of the $S_{cc11}$ was less than 10), which indicated that the EMI performance got worse.

As described above, in a differential signaling cable 1 according to the present invention, an interval between two signal conductors 2 is specified so that even-mode impedance becomes 1.5 to 1.9 times that of odd-mode impedance. By doing so, it is possible to reduce the skew and the differential-to-common-mode conversion quantity, to keep the transmission loss practically small, to maintain good EMI performance, and to prevent signal waveform from deteriorating. As a result, transmission of high-speed (high-rate) signals of several Gbps or more becomes possible between electronic devices or inside an electronic device; thus, performance of electronic devices can be improved.

Furthermore, in a differential signaling cable 1 according to the present invention, because the periphery of signal conductors 2 are covered in a batch by an insulator 3 formed by extrusion molding, it is possible to reduce the fluctuation of the size of the cable in its longitudinal direction and to prevent characteristic impedance from fluctuating. Moreover, in a differential signaling cable 1 of the invention, since $Z_{even}/Z_{odd}$ can be easily adjusted by changing the interval between the two signal conductors 2 at the time of extrusion molding, it is not necessary to adopt complicated conventional methods, such as wrapping a thick foaming agent tape around an insulator, or deforming the insulator by tightly wrapping it with a tape-like shield conductor. Consequently, stable production becomes possible.

Additionally, in a differential signaling cable 1 of the invention, because a drain wire 5 is disposed next to the signal conductors 2, even if the interval between the two signal conductors 2 is small, mounting to a board or a connector is easy, and the exposed portion of the shield conductor 4 can be made small. Therefore, electrical characteristics in a mounting portion do not deteriorate much.

Next, other embodiments of the present invention will be described.

Second Embodiment of Present Invention

Figure 4:
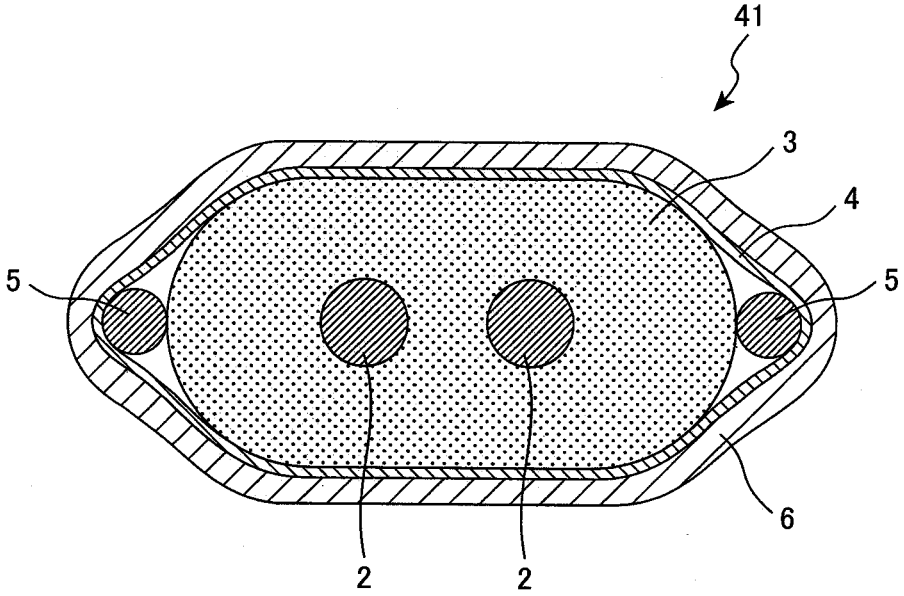
FIG. 4 is a schematic illustration showing a cross-sectional view of an exemplary differential signaling cable according to a second embodiment of the present invention.

FIG. 4 is a schematic illustration showing a cross-sectional view of an exemplary differential signaling cable according to a second embodiment of the present invention. A differential signaling cable 41 shown in FIG. 4 has the same structure as that of the differential signaling cable shown in FIG. 1, and the difference is that a drain wire 5 is disposed on both the right and left side of the insulator 3 in the differential signaling cable 41. Both drain wires 5 and both signal conductors 2 are linearly disposed along the width direction of the insulator 3.

Because drain wires 5 are located bilaterally symmetrically in the differential signaling cable 41, the bilaterally symmetric property of electromagnetic waves propagating through the signal conductors 2 becomes good, and the skew and the differential-to-common-mode conversion quantity can be further reduced.

Third Embodiment of Present Invention

Figure 5:
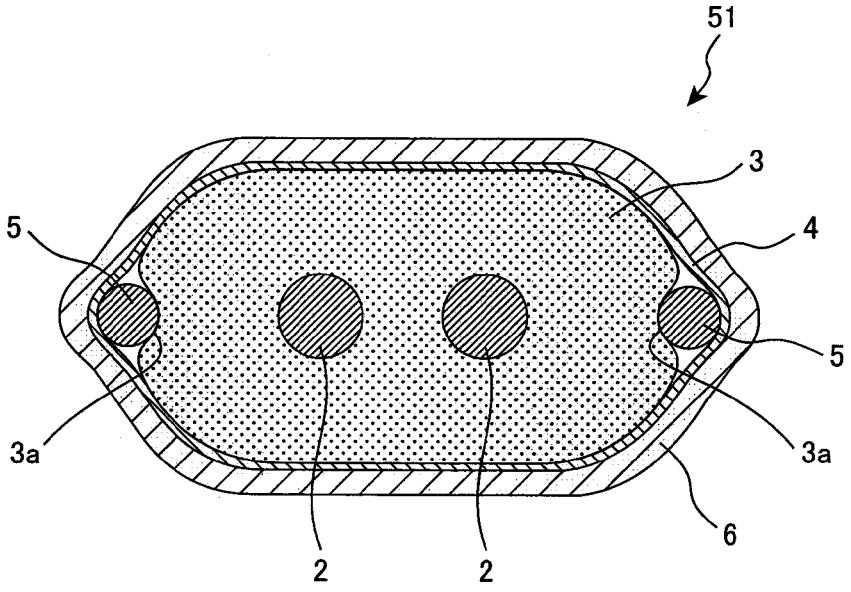
FIG. 5 is a schematic illustration showing a cross-sectional view of an exemplary differential signaling cable according to a third embodiment of the present invention.

FIG. 5 is a schematic illustration showing a cross-sectional view of an exemplary differential signaling cable according to a third embodiment of the present invention. A differential signaling cable 51 shown in FIG. 5 is structured such that in a differential signaling cable 41 in FIG. 4, an engagement groove 3*a* with which a drain wire 5 is engaged is formed on the ends on both sides of the insulator 3 in its width direction along the longitudinal direction to securely engage the drain wires 5 with the engagement grooves 3*a*.

For example, the engagement groove 3*a* can be easily formed by providing a protrusion at the ejecting portion of an extruding machine (where an engagement groove 3*a* is formed) when extrusion molding the insulator 3. The depth of the engagement groove 3*a* should not be too deep so that the drain wires 5 can be pressed by the shield conductor 4 and the conductive surface (metal foil) of the shield conductor 4 can come in sufficient contact with the drain wires 5.

In the differential signaling cable 51, because drain wires 5 are securely engaged with engagement grooves 3*a* formed in the insulator 3, positions of the drain wires 5 are stable. Consequently, the bilaterally symmetric property of the cross-sectional structure of the cable is maintained; thus, the bilaterally symmetric property of electromagnetic waves propagating through the signal conductors 2 is good, and the skew and the differential-to-common-mode conversion quantity can be further reduced. Furthermore, it is possible to significantly reduce defective products caused by deviation of the position of the drain wire 5, thereby increasing the speed for producing differential signaling cables 51 and decreasing the production cost.

Fourth Embodiment of Present Invention

Figure 6:
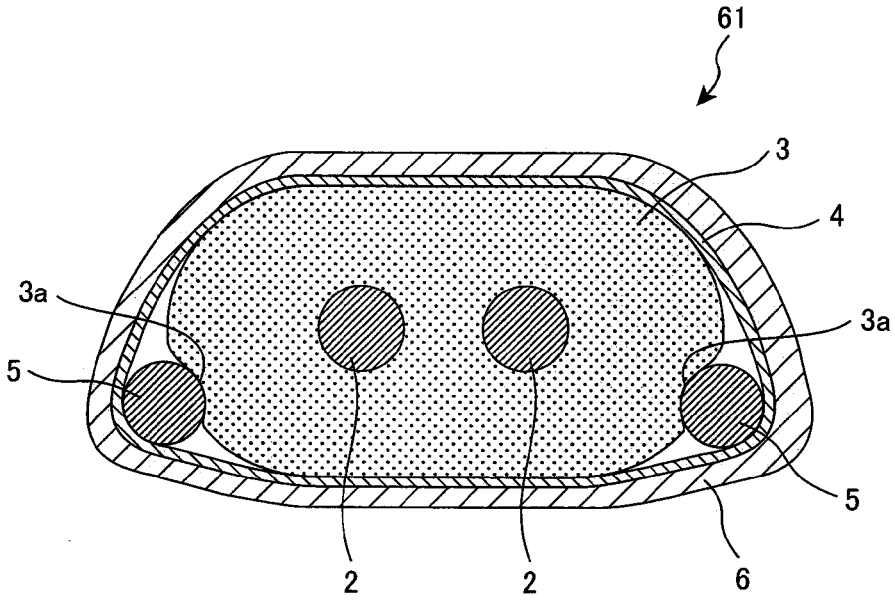
FIG. 6 is a schematic illustration showing a cross-sectional view of an exemplary differential signaling cable according to a fourth embodiment of the present invention.

FIG. 6 is a schematic illustration showing a cross-sectional view of an exemplary differential signaling cable according to a fourth embodiment of the present invention. A differential signaling cable 61 shown in FIG. 6 is structured such that in a differential signaling cable 51 in FIG. 5, an engagement groove 3*a* with which a drain wire 5 is engaged is not formed at the center (on the centerline) of the thickness direction of the insulator 3, but is formed at a location that deviates from the center of the thickness direction of the insulator 3 (a deviation located in the downward direction in FIG. 6).

That is, in the differential signaling cable 61, both drain wires 5 are disposed in locations which deviate from the center of the thickness direction of the insulator 3. The two drain wires 5 are linearly disposed along the width direction of the insulator 3.

Figure 8:
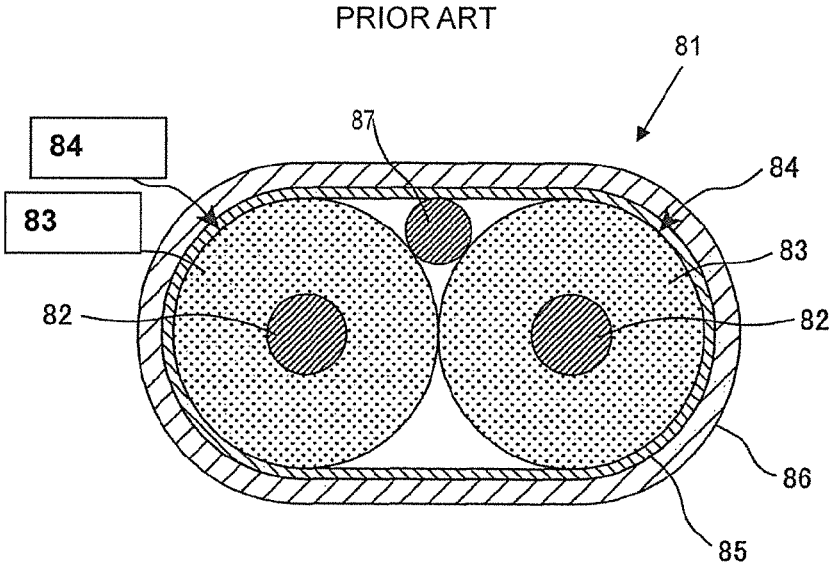
FIG. 8 is a schematic illustration showing a cross-sectional view of a twin-axial cable as a conventional differential signaling cable.
Figure 9:
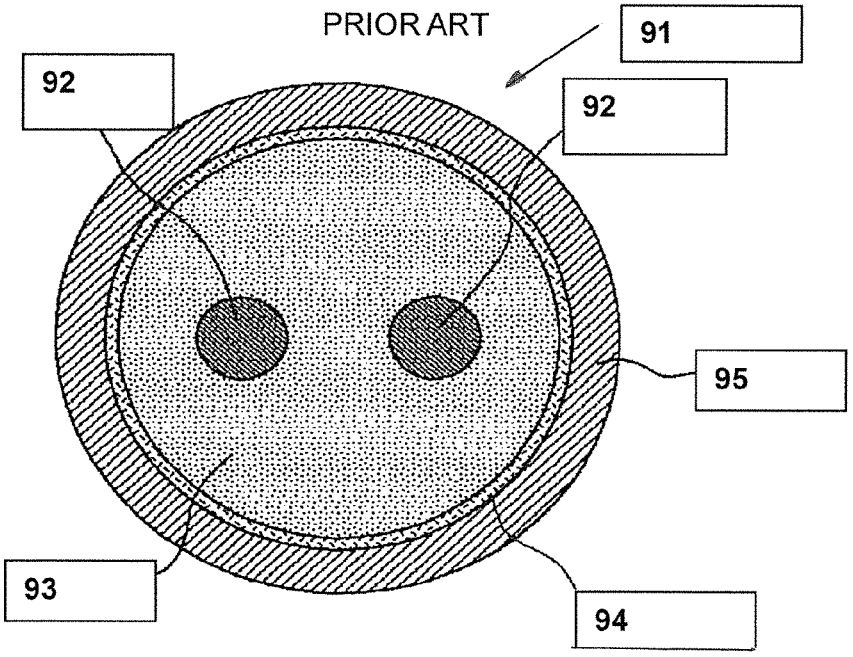
FIG. 9 is a schematic illustration showing a cross-sectional view of another twin-axial cable as a conventional differential signaling cable.
Figure 10:
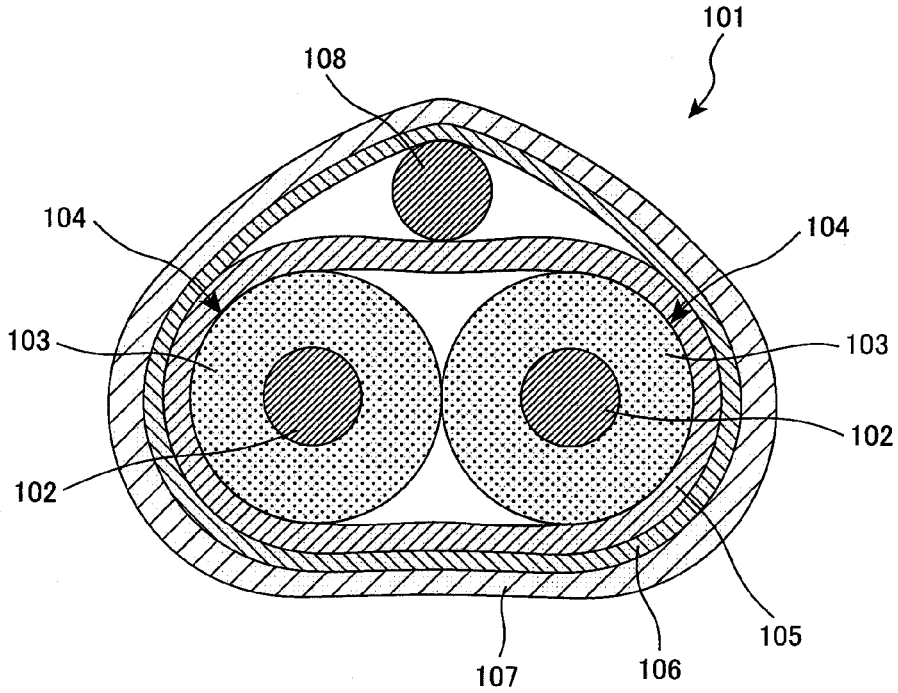
FIG. 10 PRIOR ART
FIG. 10 is a schematic illustration showing a cross-sectional view of still another twin-axial cable as a conventional differential signaling cable.
Figure 11:
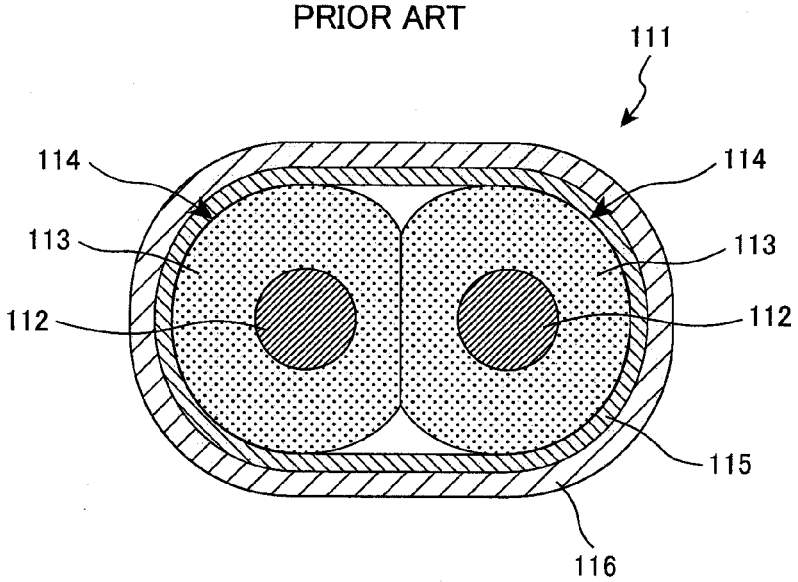
FIG. 11 PRIOR ART
FIG. 11 is a schematic illustration showing a cross-sectional view of still another twin-axial cable as a conventional differential signaling cable.

In a differential signaling cable equipped with two conventional insulated wires (see, e.g., FIG. 8), polarities of the signal conductors can be identified by using insulated wires in different colors. However, when two signal conductors are covered in a batch with an insulator (see, e.g., FIG. 9), it becomes difficult to identify the polarities of the signal conductors, which may decrease work efficiency in mounting the differential signaling cable onto a printed-circuit board or the like.

In a differential signaling cable 61, drain wires 5 are not located at the center of the thickness direction of the cross-section of the cable and deviate from the center position. Therefore, it becomes possible to identify the polarities of the signal conductors 2 by confirming the positions of the drain wires 5 when mounting after the jacket 6 and the shield conductor 4 have been exposed. That is, according to the differential signaling cable 61, it is possible to easily identify the polarities of the signal conductors 2, thereby increasing workability in mounting the cable onto a printed-circuit board or the like.

Fifth Embodiment of Present Invention

Figure 7:
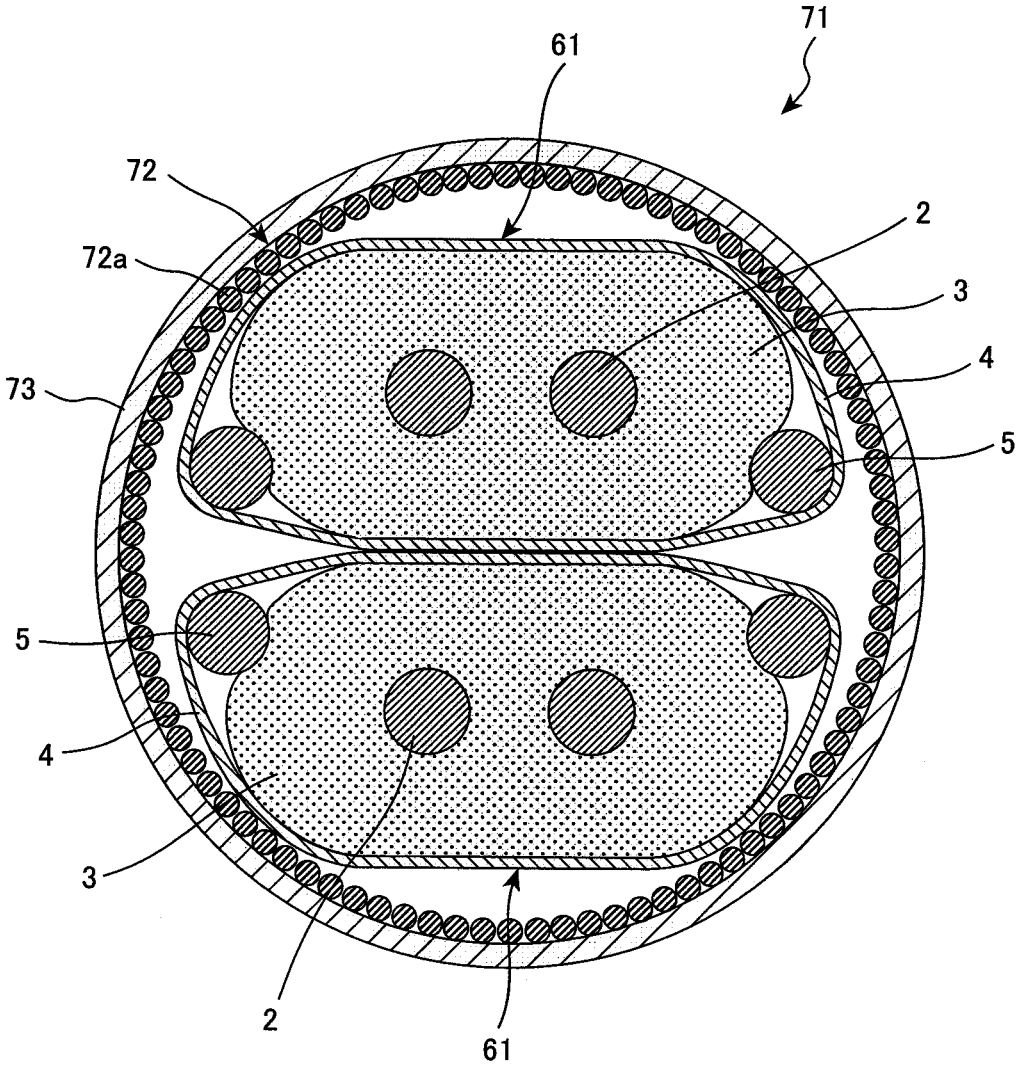
FIG. 7 is a schematic illustration showing a cross-sectional view of an exemplary transmission cable assembly according to a fifth embodiment of the present invention.

FIG. 7 is a schematic illustration showing a cross-sectional view of an exemplary transmission cable assembly according to a fifth embodiment of the present invention. A transmission cable assembly 71 shown in FIG. 7 is formed such that two differential signaling cables 61, e.g., in FIG. 6 (without jacket 6) are bundled, a shield conductor 72 is provided in a batch on the periphery of the bundled cables, and then the outer periphery of the shield conductor 72 is covered by a jacket 73 made of an insulator.

The differential signaling cables 61 are bundled so that the sides on which two drain wires 5 are disposed face each other. Herein, a braided wire 72*a* is used as a covering shield conductor 72, however, a metal foil tape can also be used.

To execute signal transmission, a transmission cable assembly 71 comprises a differential signaling cable 61 for transmitting (sending) signals and another differential signaling cable 61 for receiving signals. Furthermore, in order to cope with EMI and EMC (electromagnetic compatibility), the two differential signaling cables 61 are covered in a batch by a shield conductor 72. Thus, both the transmission characteristics and the EMI and EMC performance are maintained in good condition in a compact structure.

As stated above, according to the transmission cable assembly 71, it is possible to maintain good transmission characteristics and good EMI and EMC performance. Therefore, it is possible to use the transmission cable assembly 71 as a directly attached cable for 10 GbE by providing SFP (small form factor pluggable)+transceiver (optical module shaped connector) on both ends of the transmission cable assembly 71.

Herein, description was made about the situation where two differential signaling cables 61 are used for the transmission cable assembly 71. However, it is possible to use three or more differential signaling cables 61, or use a differential signaling cable 1 in FIG. 1, a differential signaling cable 41 in FIG. 4, or a differential signaling cable 51 in FIG. 5 instead of using the differential signaling cable 61.

Although the present invention has been described with respect to the specific embodiments for complete and clear disclosure, the appended claims are not to be thus limited but are to be construed as embodying all modifications and alternative constructions that may occur to one skilled in the art which fairly fall within the basic teaching herein set forth.

What is claimed is:

1. A differential signaling cable, comprising:

a pair of signal conductors provided in parallel, longitudinally within the differential signaling cable;

an insulator covering a periphery of the pair of signal conductors as a whole, wherein only the insulator is between the pair of signal conductors; and a shield conductor provided on an outer periphery of the insulator, wherein an interval between the pair of signal conductors is set so that an even-mode impedance of the pair of signal conductors having the interval fixed by embedment within the insulator and covered by the shield conductor, is in a range from 1.50 to less than 1.58 times an odd-mode impedance for improved skew and differential mode insertion loss experienced during a transmission of high-speed signals of at least 10 Gbps, the improved skew and differential mode insertion loss being in comparison both to skew experienced with below 1.50 times the odd-mode impedance and differential mode insertion loss experienced with above 1.58 times the odd-mode impedance.

2. The differential signaling cable according to claim 1, wherein a length of the insulator in a width direction of the insulator in which the pair of signal conductors is arranged, is longer than a length in a thickness direction of the insulator perpendicular to the width direction, and wherein the pair of signal conductors is disposed at a center of the thickness direction of the insulator.

3. The differential signaling cable according to claim 2, wherein a ratio of the length of the insulator in the width direction to the length in the thickness direction is 2:1.

4. The differential signaling cable according to claim 2, further comprising:

a drain wire longitudinally disposed on an end on one side or ends on both sides of the insulator in the width direction, the drain wire being provided between the insulator and the shield conductor, the drain wire being electrically connected to the shield conductor.

5. The differential signaling cable according to claim 4, wherein the drain wire and the signal conductors are linearly disposed along the width direction of the insulator.

6. The differential signaling cable according to claim 4, wherein each of the drain wires is disposed on the ends on both sides of the insulator in its width direction, wherein both of the drain wires are linearly disposed along the width direction of the insulator, and wherein both of the drain wires are disposed in locations deviating from the center of the thickness direction of the insulator.

7. The differential signaling cable according to claim 4, wherein the drain wire is engaged with an engagement groove formed on the end on one side or the drain wires are engaged with engagement grooves fomied on the ends on both sides of the insulator in the width direction.

8. A transmission cable assembly, wherein at least two or more of differential signaling cables according to claim 1 are bundled, wherein a batch-covering shield conductor is provided on a periphery of the bundled cables as a whole, and wherein an outer periphery of the batch-covering shield conductor is covered with a jacket comprising an insulator.

9. The differential signaling cable according to claim 1, further comprising:

a jacket for cable protection provided on an outer periphery of the shield conductor.

10. The differential signaling cable according to claim 1, wherein the insulator comprises a monolithic insulator.

11. The differential signaling cable according to claim 1, wherein the pair of signal conductors comprises a pair of signal wires.

12. The differential signaling cable according to claim 1, wherein the interval between the pair of signal conductors is set such that the even-mode impedance of the pair of signal conductors, having the interval fixed by embedment within the insulator and covered by the shield conductor, is about 1.50 times of the odd-mode impedance.

13. The differential signaling cable according to claim 1, wherein the pair of signal conductors is configured such that a differential impedance of the pair of signal conductors is about 100 Ω.

14. The differential signaling cable according to claim 1, wherein the pair of signal conductors is configured such that the even-mode impedance is in a range from 75 Ω to 95 Ω.

15. A production method for a differential signaling cable, the production method comprising:

providing a pair of signal conductors in parallel longitudinally within the differential signaling cable;

covering a periphery of the pair of signal conductors as a whole with an insulator; and covering an outer periphery of the insulator with a shield conductor, wherein each conductor of the pair of signal conductors is disposed such that an interval therebetween is set so that an even-mode impedance of the pair of signal conductors having the interval fixed by embedment within the insulator and covered by the shield conductor, is in a range from 1.50 to less than 1.58 times an odd-mode impedance for improved skew and differential mode insertion loss experienced during transmission of high-speed signals of at least 10 Gbps, the improved skew and differential mode insertion loss being in comparison both to skew experienced with below 1.50 times odd-mode impedance and differential mode insertion loss experienced with above 1.58 times odd-mode impedance, and wherein the insulator is formed in a batch on the periphery of the pair of signal conductors by an extrusion molding, such that only the insulator is disposed between the pair of signal conductors.

16. The production method according to claim 15, wherein the pair of signal conductors comprises a pair of signal wires.

17. The production method according to claim 15, wherein the insulator comprises a monolithic insulator.

18. The production method according to claim 15, wherein the interval between the pair of signal conductors is set such that the even-mode impedance of the pair of signal conductors, having the interval fixed by embedment within the insulator and covered by the shield conductor, is about 1.50 times of the odd-mode impedance.

19. The production method according to claim 15, wherein the pair of signal conductors is configured such that a differential impedance of the pair of signal conductors is about 100 Ω.

20. The production method according to claim 15, wherein the pair of signal conductors is configured such that the even-mode impedance is in a range from 75 Ω to 95 Ω.

* * * * *